United States Patent [19]

Toda et al.

[11] 4,224,403

[45] Sep. 23, 1980

[54] METHOD FOR PREVENTING THE DEGRADATION OF A HYDROPHILIC COLLOID SOLUTION FOR SILVER HALIDE PHOTOGRAPHIC LIGHT-SENSITIVE MATERIAL

[75] Inventors: Yuzo Toda; Keiichi Adachi; Shoji Ishiguro, all of Minami-ashigara; Yasuhiro Nakayama, Fujinomiya, all of Japan

[73] Assignee: Fuji Photo Film Co., Ltd., Minami-ashigara, Japan

[21] Appl. No.: 930,842

[22] Filed: Aug. 3, 1978

[30] Foreign Application Priority Data

Aug. 3, 1977 [JP] Japan ..... 52/93232

[51] Int. Cl.[2] ..... G03C 1/02; G03C 1/34; G03C 1/38

[52] U.S. Cl. ..... 430/537; 430/539; 430/545; 430/546; 430/607; 430/614; 430/627; 430/631; 430/640; 430/642; 430/935; 430/939

[58] Field of Search ..... 96/109, 94 R, 107, 114, 96/114.5; 424/167, 269, 275

[56] References Cited

U.S. PATENT DOCUMENTS 2,870,015 1/1959 Allen et al. ..... 96/109

*Primary Examiner*—Edward O. Kimlin

*Attorney, Agent, or Firm*—Sughrue, Rothwell, Mion, Zinn and Macpeak

[57] ABSTRACT

A method for preventing the degradation of a hydrophilic colloid solution for a silver halide photographic light-sensitive material of which the viscosity has been or is to be increased using an anionic polymer containing an acid group, which comprises incorporating into the hydrophilic colloid solution at least one compound represented by the formula (I):

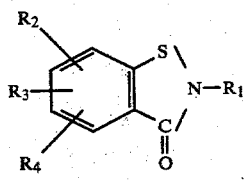

(I)

wherein Rrepresents a hydrogen atom or an alkyl group; and $R_2$, $R_3$ and $R_4$, which may be the same or different, each represents a hydrogen atom, a halogen atom, an alkyl group or an alkoxy group.

14 Claims, No Drawings

METHOD FOR PREVENTING THE DEGRADATION OF A HYDROPHILIC COLLOID SOLUTION FOR SILVER HALIDE PHOTOGRAPHIC LIGHT-SENSITIVE MATERIAL

BACKGROUND OF THE INVENTION

1. Field of the Invention

The present invention relates to the preparation of silver halide photographic light-sensitive materials, and more particularly, to a novel method for preventing the degradation of a hydrophilic colloid which is employed as a binder for silver halide photographic materials.

2. Description of the Prior Art

In general, silver halide photographic light-sensitive materials comprise a support having thereon one or more light-sensitive silver halide emulsion layers and, depending upon necessity, having further thereon layers such as a subbing layer, an intermediate layer, a filter layer, an antihalation layer, a protective layer, etc. Known hydrophilic colloids which are employed as binders for these photographic layers include proteins such as gelatin, albumin, casein, etc.; cellulose derivatives such as carboxymethyl cellulose, hydroxyethyl cellulose, etc.; saccharide derivatives such as agar, sodium alginate, starch derivatives, etc.; synthetic hydrophilic colloids such as polyvinyl alcohol, poly-N-vinylpyrrolidone, polyacrylic copolymers, etc. Of these, gelatin is most generally employed. Further, the gelatin can be replaced partially or completely by gelatin derivatives, i.e., those obtained by treating the amino groups, imino groups, hydroxy groups or carboxyl groups which are present as functional groups in the gelatin, with compounds capable of reacting with these groups, or by graft polymers obtained by grafting the molecular chains of high molecular weight substances, and the like, onto the gelatin molecule. Alternatively, use of two or more kinds of hydrophilic colloids, e.g., the use of a mixture of gelatin and other high molecular weight substances, in combination is also known.

On the other hand, it is known that these hydrophilic colloids employed for silver halide photographic materials deteriorate, decay or are decomposed by the action of bacteria, molds, yeasts, etc. For example, upon preparation of photographic materials, if these hydrophilic colloids deteriorate or are decomposed, the viscosity of the coating solution and the physical strength of the coated layer are reduced, and, in addition thereto, localized decomposition of these hydrophilic colloids occurs so that uniformity of the coated layers is lost, or the decomposition products of hydrophilic colloids adversely affect the photographic properties in certain instances.

In order to prevent this deterioration or decomposition (hereinafter the term "degradation" will be used to describe collectively all of these deleterious changes which occur) of hydrophilic colloids employed for photographic materials due to bacteria, molds, yeasts, etc., preservatives or antifungal agents have been incorporated into solutions containing the hydrophilic colloids described above at some stage during the preparation of the photographic materials.

Agents which can be used, in general, as preservatives or antifungal materials include, for example, aromatic hydroxy compounds such as phenol, thymol, trichlorophenol, tetrachlorophenol, pentachlorophenol, cresol, p-chloro-m-cresol, o-phenylphenol, benzylphenol, 2-benzyl-4-chlorophenol, chlorophen, dichlorophen, bromochlorophen, 2,2'-dihydroxy-5,5'-dichlorodiphenyl monosulfide, 2,4,4'-trichloro-2'-hydroxydiphenyl ether, 3,4,5-tribromosalicyl anilide, or the salts thereof; compounds containing a carbonyl group such as formaldehyde, paraformaldehyde, chloroacetaldehyde, glutaraldehyde, chloroacetamide, methylol chloroacetamide; carboxylic acids or esters thereof such as benzoic acid, monobromoacetic acid esters, p-hydroxybenzoic acid esters, sorbic acid; amines such as hexamethylenetetramine, alkylguanidines, nitromethylbenzylethylenediamine; disulfides such as tetramethylthiuram disulfide; nitrogen-containing heterocyclic compounds such as 2-mercaptobenzothiazole, 2-(4-thiazolyl)benzimidazole, 2-methoxycarbonylaminobenzimidazole; organic mercury compounds such as mercury phenylacetate, mercury phenylpropionate, mercury phenyloleate; antibiotics such as neomycin, kanamycin, polymycin, streptomycin, furamycin, and the like. Some of these compounds are also known to be suitable for use in photography. However, the effects of these agents are exhibited only when a large amount of these agents is added to hydrophilic colloids and, in most cases, these agents are hazardous to humans, effective only against certain bacteria, are harmful photographically, or mutually interact with other photographic additives. For example, phenols such as phenol and thymol which are very often employed do not provide sufficient preservation effects unless they are present in the hydrophilic colloids in an amount of about 2 wt% or more. In addition, phenols provide less preservation and antifungal effects against molds or yeasts and are strongly toxic to humans, even though they are effective against bacteria. Further, aldehydes such as formaldehyde are effective against bacteria but only slightly effective against molds and are harmful to humans and further fog in silver halide photographic light-sensitive materials tends to occur when they are used. Further, heterocyclic compounds such as benzothiazole result in deleterious photographic effects such as desensitization in certain instances. Organic mercury compounds are only slightly effective against bacteria and are harmful to humans, although they are effective against molds. Antibiotics such as neomycin, kanamycin are ineffective against yeasts, although they are effective against bacteria.

As described above, many preservatives are known. However, these conventional preservatives are not directly usable as preservatives for photography. This is because, as is well recognized in the art, extremely delicate handling is necessary in photographic area. All photographic additives must have the following photographic properties: (1) they must not cause a reduction in sensitivity to occur, especially during storage under high temperature and high humidity, (2) they must not cause a change in gamma to occur, (3) they must not cause fog, (4) they must not adversely affect the stability of latent images formed, and (5) the processing must be smooth when they are used. For example, it is known that conventional phenol type preservatives cause desensitization under the conditions of high temperature and high humidity when the amount employed is high in order to obtain sufficient preserving activity. Neomycin also causes desensitization at high humidity and high temperature. Therefore, it has been long desired to develop all-round preservatives which do not adversely affect photographic properties.

On the other hand, uniformity of the layers of photographic light-sensitive materials and coating at a high speed are desired. As a result, it is necessary to control the viscosities of respective layers to desired values in order to enable uniform coating at high speed, particularly where two or more layers are coated simultaneously or continuously using coating techniques such as extrusion coating, curtain coating, air knife coating, or the like. In particular, where the coating is onto a support travelling at a speed of about 20 m/min or more, it is difficult to achieve uniform coating if the viscosity of the coating solution is low. In addition, where two or more layers are simultaneously coated, the relative values of the viscosities of the coating solutions for the respective layers must be adjusted so that uniform coating can be achieved.

Viscosity-increasing agents must be added to photographic coating solutions to facilitate uniform coating of the coating solution onto a support. Particularly in the past several years, the demand for high speed coating has been increasing and high speed coating on an industrial scale is achieved by increasing the viscosity of a coating solution.

Another demand is to improve the quality of a photographic element by converting photographic layers into a multilayered structure, generally composed of 6 to 20 layers. In such a case, it is essential for the viscosities of the coating solutions to be well balanced among the layers by purposely using viscosity-increasing agent. In addition, enhancement of viscosity using viscosity-increasing agents saves gelatin which is expensive since gelatin is often employed also as a viscosity-controlling agent due to the photographically inert properties of gelatin.

It is known to incorporate polymers containing acid groups such as carboxyl groups or sulfonyl groups into coating solutions to increase the viscosity of coating solutions for photographic layers.

For example, a method for increasing the viscosity by incorporating a compound of the general formulas:

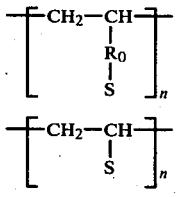

wherein $R_0$ represents an aliphatic or aromatic hydrocarbon residue and S represents a sulfonic acid group, a salt thereof or a derivative thereof, $—SO_3R'_1$, $—SO_3X$, or $—SO_2NR'_1R'_2$, wherein $R'_1$ and $R'_2$, each represents a hydrogen atom, an alkyl group, an aryl group or an aralkyl group; and X represents an ammonium group, a potassium atom, a sodium atom or another alkali metal atom; into a solution containing gelatin is described in Japanese Patent Publication No. 3582/1960.

Further, *Photographic Science and Engineering,* Vol. 14, pages 178 to 183 (1970) discloses that ammonium salts of copolymers of maleic anhydride and methyl vinyl ether, polystyrene sodium sulfonate, polyvinyl ammonium phthalate, dextran sodium sulfate, etc., can be employed as viscosity-increasing agents for gelatin and derivatives thereof. In addition, Japanese patent application (OPI) No. 45830/1972 (The term "OPI" as used herein refers to a "published unexamined Japanese patent application") discloses that polymers or copolymers of acrylic acid, maleic acid or styrene sulfonic acid, or cellulose derivatives containing acid groups (e.g., carboxymethyl cellulose, cellulose sulfate) can be incorporated into a gelatin intermediate layer.

As stated above, phenol preservatives such as phenol or thymol which are generally employed as preservatives for hydrophilic colloids for photography have the disadvantage that the preservation effect is not obtained unless a large amount thereof is added to hydrophilic colloids, due to their poor preservation effect. For instance, in the case of a photographic coating solution using gelatin as a hydrophilic colloid, a sufficient preservation effect is not obtained unless the phenols are employed in an amount of 2 wt% or more based on the gelatin (solids content). As such, where a large amount of phenol is incorporated in photographic coating solutions, there is the disadvantage that it is difficult to produce a uniformly coated layer since gelatin tends to aggregate in the coating solution. Where anionic polymers for increasing the viscosity are incorporated into photographic coating solutions containing a phenol, a large amount of a viscosity-increasing agent must be added because the viscosity-increasing effect is prevented by the phenol.

A photographic hydrophilic colloid solution, e.g., an aqueous gelatin solution, necessarily has a cationic pH. In order to prevent degradation of such a photographic solution, preserving activity can be most effectively achieved by causing an ionic interaction of the resulting cationic phase with an anionic compound. In addition, bacteria themselves do not grow in a low pH range so that the use of an acidic compound is dictated as a preserving agent.

Conventional preservatives severely restricted as to functional requirements are extremely pH-dependent. For example, benzoic acid, sorbic acid and benzyl alcohol, which are most typical preservatives for a gelatin solution, exhibit their preserving activity only up to a neutral pH at the highest.

The most serious problem is, as stated above, the undesired reduction in viscosity of the system when such conventional preservatives and anionic polymer viscosity-increasing agents are used in combination.

As a result, it has been desired to develop preservatives for photographic hydrophilic colloids which exhibit a variety of preservation effects and which can be used in a small amount, i.e., which exhibit marked antidegradation and antifungal effects against bacteria, yeasts, molds, etc. In addition, it has been desired to develop preservatives for photographic hydrophilic colloids which do not adversely affect the viscosity-increasing effects of viscosity-increasing agents.

SUMMARY OF THE INVENTION

Thus, an object of the present invention is to provide a method for preserving solutions of hydrophilic colloids for silver halide photographic light-sensitive materials which contain or are to contain anionic polymers for the purposes of viscosity-increase.

This and other objects of the present invention will become apparent from the detailed description given hereafter.

The above object and other objects of the invention are attained by the process of this invention which comprises incorporating into a solution of a binder employed in silver halide photographic light-sensitive materials, whose viscosity has been or is to be increased with anionic polymers, at least one compound having the formula (I):

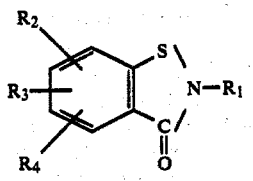

(I)

wherein $R_1$ is a hydrogen atom or an alkyl group; $R_2$, $R_3$ and $R_4$, which may be the same or different, each represents a hydrogen atom, a halogen atom, an alkyl group or an alkoxy group.

DETAILED DESCRIPTION OF THE INVENTION

In the general formula (I) above, $R_1$ represents a hydrogen atom or a straight or branched chain alkyl group having 1 to 20 carbon atoms (for example, a methyl group, an ethyl group, an n-propyl group, an n-butyl group, a tert-butyl group, a tert-octyl group, an n-dodecyl group, an n-heptadecyl group, an n-octadecyl group, etc.), which may also be substituted with one or more of a sulfo group, a carboxyl group or a halogen atom (e.g., a chlorine atom, a bromine atom, a fluorine atom, etc.).

$R_2$, $R_3$ and $R_4$ each represents a hydrogen atom, a halogen atom (e.g., a chlorine atom, a bromine atom, etc.), a straight or branched chain alkyl group having 1 to 6 carbon atoms and which may be substituted (e.g., a methyl group, an ethyl group, an iso-propyl group, an n-propyl group, an n-butyl group, a sec-butyl group, a tert-butyl group, a tert-amyl group, an n-hexyl group, etc.) or an alkoxy group having 1 to 6 carbon atoms (e.g., a methoxy group, an ethoxy group, an n-propoxy group, an iso-propoxy group, an n-butoxy group, an iso-butoxy group, an n-pentyloxy group, an iso-pentyloxy group, etc.).

Specific examples of compounds represented by the formula (I) above are shown below but the present invention is not to be construed as being limited thereto.

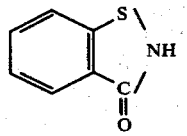

(1)

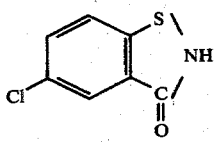

(2)

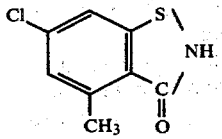

(3)

-continued

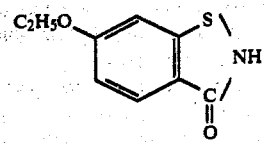

(4)

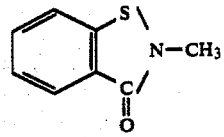

(5)

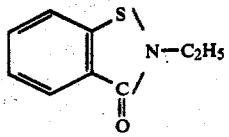

(6)

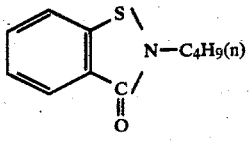

(7)

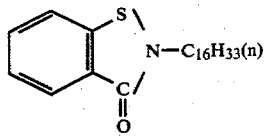

(8)

Of the above described compounds, compounds (1) and (2) are particularly preferred due to the high degree of preservation effects achieved therewith.

The preservation effects achieved with the compound represented by the formula (I) above are not limited to bacteria only but marked preservation effects as to a variety of bacteria, yeasts and molds are achieved. In addition, the preservation effect is extremely high so that a sufficient amount added to hydrophilic colloids is 1/10 or less, as compared to phenols, and the same preservation effects to the same degree are achieved. In addition, where polymers containing acid groups are present in the hydrophilic colloids, the compound represented by the formula (I) exhibits sufficient preservation effects and does not cause any reduction in viscosity to occur. Furthermore, the compound represented by the formula (I) possesses marked preservation effects over a wide range of pH's.

The compounds which fall within the formula (I) above are described in, for example, U.S. Pat. No. 2,870,015, in which they are employed as stabilizers or antifogging agents for photography. However, there is no disclosure in the art that these compounds could be used as preservatives for hydrophilic colloids for silver halide photographic light-sensitive materials.

Of the compounds represented by the formula (I) above, the compound in which $R_1$, $R_2$, $R_3$ and $R_4$ each represent a hydrogen atom is described as a preservative in *Farbe und Lack*, Vol. 82, pages 108–125 (1976). However, there is no disclosure that such a compound would be effective as a preservative for hydrophilic colloids for silver halide photographic light-sensitive materials. As stated above, as preservatives for hydrophilic colloids for silver halide photographic light-sensitive materials, there must be no interaction with other photographic additives (e.g., viscosity-increasing agents), there must be no adverse influences on the photographic properties, effective preservation effects must be achieved when a small amount is used, there must be no hazards to humans, etc. It has been found that the compound represented by the formula (I) above satisfies all of these requirements.

One embodiment of the present invention comprises incorporating at least one compound of the formula (I) above into a solution containing hydrophilic colloids, whose viscosity has been or is to be increased with anionic polymers containing acid groups, at any stage during preparation of the photographic materials. The compound of the formula (I) can be added during steps prior to coating such as during preparation of the silver halide photographic emulsion, while emulsion-dispersing a coupler, during preparation of a photographic coating solution or following the coating step. In addition, after the compound of the formula (I) above is added, the viscosity can also be increased using anionic polymers containing acid groups. The compound represented by the formula (I) above can be added to solutions containing hydrophilic colloids after the compound is dissolved in water or a water-miscible organic solvent having a boiling point lower than 175° C. (for example, methanol, ethanol, acetone, dimethylformamide, ethyl acetate, etc.).

The compound represented by the formula (I) of the present invention and viscosity-increasing agents can be incorporated into various layers during preparation of the photographic materials such as any layer of the photographic materials containing a hydrophilic colloid, e.g., a light-sensitive silver halide emulsion layer, a subbing layer, an intermediate layer, a filter layer, an antihalation layer, a protective layer, etc.

Hydrophilic colloids with which the compound represented by the formula (I) of the present invention is useful can be any kind of hydrophilic colloid as described above or can be a combination of two or more hydrophilic colloids.

The compound represented by the formula (I) above used in the present invention can be employed in an amount of about $1\times10^{-3}$ to about 5 wt% based on the dry weight of the hydrophilic colloid, preferably $1\times10^{-2}$ to $2.5\times10^{-1}$ wt%.

The compound represented by the formula (I) above used in the present invention can also be incorporated into solutions containing hydrophilic colloids as solutions after dissolving the compound in water or organic solvents, for example, alcohols (e.g., methanol, ethanol, isopropanol, butanol, etc.), ethers (e.g., dimethyl ether, ethyl methyl ether, diethyl ether, 1-ethoxypropane, etc.), glycols (e.g., 1,2-ethanediol, 1,2-propanediol, 1,3-propanediol, etc.), ketones (e.g., acetone, methyl ethyl ketone, 3-pentanone, etc.), esters (e.g., ethyl formate, methyl acetate, ethyl acetate, etc.), amides (e.g., formamide, acetamide, succinic amide, etc.), and, of these, preferably in solvents which do not adversely affect photographic properties. Alternatively, the compound represented by the formula (I) can also be incorporated into solutions containing hydrophilic colloids after the compounds represented by the formula (I) are dissolved in high boiling point organic solvents having a boiling point higher than about 180° C., e.g., alkyl esters of phthalic acid such as methyl phthalate, ethyl phthalate, propyl phthalate, n-butyl phthalate, di-n-butyl phthalate, n-amyl phthalate, isoamyl phthalate and dioctyl phthalate, etc.; alkyl amides such as N,N-diethyllaurylamide; trimellitic acid esters such as tri-tert-octyl mellitate; phosphoric acid esters such as polyphenyl phosphate, tricresyl phosphate, dioctylbutyl phosphate; citric acid esters such as acetyl tributyl citrate; etc., low boiling point organic solvents having a boiling point of about 30° to about 150° C., such as lower alkyl acetates such as ethyl acetate, butyl acetate; ethyl propionate; sec-butyl alcohol, methyl isobutyl ketone; β-ethoxyethyl acetate; methyl Cellosolve acetate; etc., or solvent mixtures thereof followed by emulsion-dispersion in the presence of a surface active agent.

The viscosity-increasing agents which are preferably employed in the present invention include high molecular weight compounds having at least one sulfonic acid group, carboxylic acid group or phosphoric acid group in the side chain thereof the represent polymers or copolymers of monomers containing groups such as:

$$-SO_3M,\ -COOM,\ -\overset{\overset{\displaystyle O}{\|}}{\underset{\underset{\displaystyle OM}{|}}{P}}-OM$$

(in which M is a hydrogen atom or a cation (e.g., Na, K, $NH_4$, etc.)), etc., e.g., styrene sulfonic acid, 2-acrylamido-2-methylpropane sulfonic acid, acrylic acid, methacrylic acid, maleic acid, half esters of maleic acid, phosphoric acid mono esters of hydroxyethyl acrylate, a cellulose sulfuric acid salt such as cellulose sulfate, etc. Of these high molecular weight compounds, polystyrene sodium sulfonate, sodium polyacrylate and sodium cellulose sulfate are particularly preferably employed.

In general, a suitable molecular weight of such a high molecular weight compound ranges from about 50,000 to about 1,000,000, and a particularly preferred range is 100,000 to 500,000.

The viscosity-increasing agents which are preferably used in the present invention are employed in an amount of from 1 to 100 wt% based on the dry weight of the hydrophilic colloid, and a particularly preferred range is between 0.5 and 20 wt%.

The viscosity-increasing agents for coating solutions containing hydrophilic colloids can be incorporated at any stage prior to coating during preparation of silver halide photographic light-sensitive materials, e.g., during preparation of the silver halide photographic emulsion, during emulsion-dispersion, during preparation of photographic coating solutions, etc.

The silver halide emulsion which can be employed in the present invention is a suspension of silver halides such as silver chloride, silver bromide, silver iodide, silver chlorobromide, silver iodobromide, silver chloroiodobromide or mixtures thereof in the hydrophilic colloids described above and can be prepared in accordance with conventional methods. For example, the silver halide emulsion can be prepared using a variety of methods, e.g., an ammonia method, a neutral method, an acidic method, etc., and also a double jet method, a control jet method, etc. In addition, the silver halide emulsion can also be prepared by mixing two or more silver halide emulsions which are separately prepared. Processes for preparing silver halide emulsions which can be used are described in, for example, C. E. K. Mees & T. H. James, *The Theory of the Photographic Process*, 3rd Ed., Macmillan Co., New York (1967), P. Grafkides, *Photographic Chemistry*, Fountain Press Co., Ltd., London (1958), etc.

The light-sensitive silver halide emulsion which can be employed in the present invention can also be chemically sensitized using the natural sensitizers present in gelatin or in accordance with the methods as described in U.S. Pat. Nos. 1,574,944, 1,623,499 and 2,410,689. The light-sensitive silver halide emulsion which is employed in the present invention can also be sensitized using palladium salts or noble metal salts such as gold salts as described in U.S. Pat. Nos. 2,448,060, 2,399,083 and 2,642,361. The light-sensitive silver halide emulsion in accordance with the present invention can also be spectrally sensitized using cyanine or merocyanine dyes.

Spectral sensitization or color sensitization can be achieved using these cyanine dyes alone or in combination with styryl dyes or the like. The choice can be made depending upon the purpose and utility of the light-sensitive materials such as wavelength range to be sensitized, sensitivity desired, etc.

The light-sensitive silver halide emulsion which can be employed in the present invention can also be reduction-sensitized with reducing agents such as tin (I) salts as described in U.S. Pat. No. 2,487,850, polyamines as described in U.S. Pat. Nos. 2,518,698 and 2,521,925.

The light-sensitive silver halide emulsion which can be employed in the present invention can also be stabilized using antifogging agents or stabilizers. Suitable compounds for these purposes are azaindenes, mercaptotetrazoles, salts of noble metals such as palladium or platinum, oximes, imidazolium salts, tetrazolium salts, etc. These compounds are described in, for example, U.S. Pat. Nos. 2,444,605, 2,886,437, 2,403,927, 3,266,897, 3,399,987, 2,597,915, 3,566,265 and 2,694,716.

The hydrophilic colloids which are employed in the light-sensitive materials of the present invention can also be hardened with hardening agents such as an aldehyde hardening agent, a methylol hardening agent, an isoxazole hardening agent, a carbodiimide hardening agent, an active halogen hardening agent, an active vinyl hardening agent, etc. The light-sensitive material of the present invention may contain, as filter dyes or irradiation-preventing agents, the compounds as described in U.S. Pat. Nos. 2,274,782, 2,527,583, 2,956,879, 3,177,078 and 3,252,921, and Japanese Pat. No. 22069/1964. These dyes can also be mordanted in a particular layer, if desired, in accordance with the method as described in U.S. Pat. No. 3,282,699.

The light-sensitive material of the present invention may contain, individually or in combination, thiazolium salts as described in U.S. Pat. Nos. 2,131,038 and 2,694,716, azaindenes as described in U.S. Pat. Nos. 2,886,437 and 2,444,605, urazoles as described in U.S. Pat. No. 3,287,135, sulfocatechols as described in U.S. Pat. No. 3,236,652, mercaptotetrazoles as described in U.S. Pat. Nos. 2,403,927, 3,266,897 and 3,397,987, nitrones and indoles as described in British Pat. No. 2,728,663.

The light-sensitive material of the present invention can contain fluorescent brightening agents such as stilbenes, triazines, oxazoles, coumarins; water-soluble whitening agents as described in German Pat. No. 972,067 and U.S. Pat. No. 2,933,390; oil-soluble whitening agents as described in German Patent 1,150,274 and U.S. Pat. No. 3,406,070.

The light-sensitive material of the present invention can also contain UV absorbants, e.g., benzotriazoles as described in U.S. Pat. No. 3,253,921, thiazolidines as described in U.S. Pat. No. 2,739,888, thiazolidones as described in U.S. Pat. No. 2,739,971.

The light-sensitive material of the present invention can further contain, as color fog preventing agents, the hydroquinone derivatives as described in U.S. Pat. Nos. 2,360,290, 2,336,327, 2,384,658, 2,403,721, 2,418,613, 2,675,314, 2,701,197, 2,704,713, 2,728,659, 2,732,300 and 2,735,765.

All of the open chain type ketomethylene yellow dye forming couplers can be advantageously employed in the lightsensitive material of the present invention. Typical examples of such couplers include benzoylacetanilide type and pivalylacetanilide type couplers. In addition, all magenta color forming couplers such as pyrazolone type and indazolone type couplers, etc., can be advantageously used. Further, all cyan color forming couplers such as phenol type, naphthol type, etc., couplers can be advantageously employed. These color couplers can possess a coupling-off group on the active carbon atom at the coupling position. Diffusion resistant couplers having a ballast group in the molecule of the color couplers are preferred. The terms "coupling-off group", "ballast group" and "diffusion resistant" are used herein in their conventional meaning with respect to color couplers and are well understood by one skilled in the art.

Hydrophobic groups having at least 8 carbon atoms such as an alkyl group or an alkylaryl group as a ballast group can be introduced into the coupler molecules using conventional methods to render the couplers diffusion resistant. The ballast group can be connected directly to the coupler skeleton, or through an amino bond, an ether bond, a thioether bond, a carbamido bond, a sulfamido bond, a urea bond, an ester bond, an imido bond, a carbonyl bond, a sulfonyl bond, etc., thereto.

Representative diffusion resistant couplers which can be used in the present invention are described below in detail.

Open chain diketomethylene type compounds are widely employed in general as yellow color dye forming couplers. Specific examples thereof are described in, for example, U.S. Pat. Nos. 3,341,331, 2,875,057 and 3,551,155, German patent application (OLS) No. 1,547,868, U.S. Pat. Nos. 3,265,506, 3,582,322, and 3,725,072, German patent application (OLS) No. 2,162,899, U.S. Pat. Nos. 3,369,895 and 3,408,194, German patent application (OLS) Nos. 2,057,941, 2,213,461, 2,219,917, 2,261,361 and 2,263,875.

5-Pyrazolone type compounds are mainly employed as magenta color forming couplers, but indazolone type compounds and cyanoacetyl compounds are also employed. Examples thereof are described in, for example, U.S. Pat. Nos. 2,439,098, 2,600,788, 3,062,653 and 3,558,319, British Pat. No. 956,261, U.S. Pat. Nos. 3,582,322, 3,615,506, 3,519,429, 3,311,476 and 3,419,319, Japanese patent application Nos. 21454/1973 and 56050/1973, German patent application (DT-AS) 1,810,464, Japanese Patent No. 2016/1969, Japanese patent application (OPI) No. 131448/1974, U.S. Pat. No. 2,983,608, etc.

Phenol or naphthol derivatives are mainly employed as cyan color forming couplers. Specific examples thereof are described in, for example, U.S. Pat. Nos. 2,369,929, 2,474,293, 2,698,794, 2,895,826, 3,311,476, 3,458,315, 3,560,212, 3,582,322, 3,591,383, 3,386,301, 2,434,272, 2,706,684, 3,034,892, and 3,583,971, German patent application (OLS) No. 2,163,811, Japanese Pat. No. 28836/1970, Japanese patent application (OPI) No. 122335/1974, etc.

In addition, development inhibitor-releasing type couplers (the so-called "DIR" couplers) or compounds releasing development inhibitors can also be present during the color forming reaction. Specific examples thereof are described in U.S. Pat. Nos. 3,148,062, 3,227,554, 3,253,924, 3,617,291, 3,622,328 and 3,705,201, British Pat. No. 1,201,110, U.S. Pat. Nos. 3,297,445, 3,379,529 and 3,639,417, Japanese patent application (OPI) Nos. 122335/1974 and 129536/1974, etc.

Two or more of the couplers described above and like couplers can be present in the same layer or the same coupler can also be present in two or more layers in order to satisfy properties required for the light-sensitive material.

The couplers and other photographic addenda can be introduced into hydrophilic colloids in photographic materials using known methods. The methods described in, for example, U.S. Pat. No. 2,322,027, etc., can be used. In general, after dissolving the couplers, etc., in high boiling point organic solvents having a boiling point higher than about 180° C., e.g., alkyl esters of phthalic acid such as methyl phthalate, ethyl phthalate, propyl phthalate, n-butyl phthalate, di-n-butyl phthalate, n-amyl phthalate, isoamyl phthalate and dioctyl phthalate, etc.; alkyl amides such as N,N-diethyllaurylamide; trimellitic acid esters such as tri-tert-octyl mellitate; phosphoric acid esters such as polyphenyl phosphate, tricresyl phosphate, dioctylbutyl phosphate; citric acid esters such as acetyl tributyl citrate; or low boiling point organic solvents having a boiling point of about 30° to about 150° C., such as lower alkyl acetates such as ethyl acetate, butyl acetate; ethyl propionate; sec-butyl alcohol, methyl isobutyl ketone; $\beta$-ethoxyethyl acetate; methyl Cellosolve acetate; etc., the solution thereof is dispersed in known hydrophilic colloids for photography. These high boiling point organic solvents and low boiling point organic solvents can be used in combination, if desired.

In addition, where the couplers possess acid groups such as carboxylic acid or sulfonic acid groups, the couplers can be introduced into hydrophilic colloids as an alkaline aqueous solution thereof.

The light-sensitive material in accordance with the present invention can also contain surface active agents, for example, natural surface active agents such as saponin, nonionic surface active agents such as alkyleneoxide type, glycerin type, glycidol type, etc., surface active agents; cationic surface active agents such as higher alkyl amines, quaternary ammonium salts, pyridine and other heterocyclic ring compounds, phosphoniums or sulfoniums, etc.; anionic surface active agents containing acid groups such as carboxylic acid groups, sulfonic acid groups, sulfuric acid groups, sulfate groups, phosphate, groups, etc.; amphoteric surface active agents such as amino acids, aminosulfonic acids, sulfates or phosphates of aminoalcohols, etc.

The light-sensitive material in accordance with the present invention can further contain color developers, development inhibitor releasing (DIR) compounds, diffusible dye releasing (DDR) couplers, etc.

The photographic coating solution used in the present invention is coated onto substantially planar materials which do not undergo a marked change in dimensional stability during processing, for example, depending upon purpose, a rigid support such as glass, a metal or a ceramic, or a flexible support. Representative examples of flexible supports are those conventionally employed in photographic light-sensitive materials and examples include a cellulose nitrate film, a cellulose acetate film, a cellulose acetate butyrate film, a cellulose acetate propionate film, a polystyrene film, a polyethylene terephthalate film, a polycarbonate film, or a laminate thereof, a thin glass plate, paper, and the like. Baryta paper on which an $\alpha$-olefin polymer, particularly an $\alpha$-olefin polymer having 2 to 10 carbon atoms such as polyethylene, polypropylene, ethylene butene copolymers are coated or laminated and synthetic resin films, to which adhesion with other high molecular weight substances has been improved and on which printability has been improved, by roughening the surface thereof, can also be used advantageously.

These supports can be transparent or opaque supports depending upon the purpose of the light-sensitive materials. In addition, in the case of transparent supports, not only colorless transparent supports but also colored transparent supports obtained by adding dyes and pigments thereto can be employed. Colored transparent supports are well known and are used in the field of X-ray films, etc., as reported in *J. SMPTE* 67, 296 (1958), etc.

Suitable opaque supports include, in addition to supports which are intrinsically opaque such as paper, those obtained by adding dyes or pigments such as titanium oxide, etc., to transparent films, synthetic resin films surface treated using the method as described in Japanese Pat. No. 19068/1972, paper or synthetic resin rendered completely light shielded by adding carbon black, dyes, etc., thereto. When adhesion between the support and the photographic emulsion layers is insufficient, a layer adhesive to both layers is usually provided as a subbing layer. In addition, in order to further improve adhesion, the surface of the support can also be preliminarily treated using a corona discharge treatment, a UV light irradiation, a flame treatment, etc.

Each of the layers of the photographic lightsensitive materials can be formed by coating using a variety of coating methods including dip coating, air knife coating, curtain coating, or extrusion coating using a hopper as described in U.S. Pat. No. 2,681,294.

Two or more layers can be coated simultaneously using the methods as described in U.S. Pat. Nos. 2,761,791, 3,508,947, 2,941,898 and 3,526,528, etc., if desired.

Any conventional methods can be employed for processing the photographic light-sensitive material prepared in accordance with the present invention. The processing temperature generally ranges between about 18° and about 50° C., but the temperature can be lower than about 18° C. or higher than about 50° C. Depending upon purpose, development processing for forming silver images (black-and-white photographic processing) and color photographic processing comprising development processing for forming color images can be employed.

Suitable developing agents for developers which can be employed for black-and-white photographic processing can be known developing agents such as dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolines, and ascorbic acid. The developers can contain, in addition, known preservatives, alkali agents, pH buffering agents, antifogging agents, and the like, and, further, as necessary, dissolution aids, color toning agents, development accelerators, surface active agents, defoaming agents, hard water softening agents, hardening agents, viscosity-imparting agents, etc.

Suitable color developing agents which can be advantageously employed include all known conventional aromatic amine dye forming developing agents, for example, N,N-diethyl-p-phenylenediamine, N-ethyl-N-hydroxyethyl-p-phenylenediamine, N-ethyl-N-hydroxyethyl-2-methyl-p-phenylenediamine, N-ethyl-β-N-methanesulfonamidoethyl-3-methyl-4-aminoaniline, N,N-dimethyl-2-methyl-p-phenylenediamine and the sulfates, hydrochlorides, sulfites, etc., thereof. In addition, the color developers can contain conventionally employed additives, for example, sulfites, carbonates, bisulfites, bromides and iodides of alkali metals, benzyl alcohol, etc.

Conventional processing baths such as a bleaching bath, a fixing bath, a stabilizing bath, etc., can be advantageously employed. Baths capable of accomplishing a combination of these functions can also be employed.

As described above, the preservatives used for photography should meet all of the photographic requirements set forth above, in addition to the main preserving activity achieved. In particular, it is particularly important for these preservatives to not adversely affect sensitivity, gamma and fog. The compound represented by the formula (I) does not adversely influence these photographic properties. This lack of adverse photographic influence is demonstrated by the Reference Example below, wherein sulfur sensitized and gold sensitized silver halide emulsions were employed since gold and sulfur sensitized emulsions are more sensitive to any change in sensitivity, gamma and fog, than a non-sensitized silver halide emulsion.

REFERENCE EXAMPLE

A 3.0 wt% methanol solution of Compound (1) was added to 100 g of a silver chlorobromide emulsion (containing 0.06 mol of silver and 10 g of gelatin) containing 30 mol% of silver bromide which had been sulfur sensitized and gold sensitized, immediately before completion of post ripening of the emulsion, at 50° C. The emulsion was coated onto a cellulose triacetate transparent support (silver coated amount: 2.0 g/m$^2$).

This sample was exposed to light for 1/50 second through a silver wedge using a tungsten light source having a color temperature of 2854° K., and then developed with a Kodak D-16 Developer, at 20° C. for 6 minutes. Thereafter, fixing, washing with water and drying were conducted in a conventional manner. The density was then measured with an automatic densitometer made by the Fuji Photo Film Co., Ltd. The photographic properties obtained are shown in Table A below.

TABLE A

| Sample | Amount of Compound (I) Added (wt %/gelatin) | Sensitivity | Gamma | Fog |
|---|---|---|---|---|
| XX | — | 1.14 | 2.95 | 0.10 |
| XXI | 0.1 | 1.15 | 2.92 | 0.10 |
| XXII | 1 | 1.14 | 2.96 | 0.10 |

As can be easily seen from the results in Table A, the photographic properties hardly change even if the compound as used in the present invention is employed.

The present invention is now explained in more detail by reference to the following Examples of the present invention. Unless otherwise indicated, all parts, percents, ratios and the like are by weight.

EXAMPLE 1

A sample prepared by adding 80 ml of a 2% aqueous solution of sodium polystyrene sulfonate (molecular weight: about 100,000) to 920 ml of a gelatin aqueous solution containing 100 g of gelatin and then adding phenol thereto in an amount of 1.25 wt% based on the dry gelatin (Sample (I)), a sample obtained by adding Compound (1) of the present invention in an amount of 0.1 wt% based on the dry gelatin (Sample (II)), and samples corresponding to Samples (I) and (II) but obtained by adding sodium cellulose sulfate instead of the polystyrene sodium sulfonate (Samples (III) and (IV)) were prepared. As degradation proceeded, decomposition of gelatin proceeded so that the viscosity decreased. Thus, the viscosity was taken as a measure of the degree of degradation. The solutions were sealed and stored at 40° C. The viscosity (in centipoise) thereof was measured with a B-type rotary viscometer (temperature: 40° C.; Rotor No.: No. 1; RPM: up to 100 cps, 60 rpm; 100–200 cps, 30 rpm; 200–500 cps, 12 rpm) and the results obtained are shown in Table 1 below.

TABLE 1

| | Sample | | | |
|---|---|---|---|---|
| | I | II | III | IV |
| Viscosity-Increasing Agent | Sodium Polystyrene Sulfonate | Sodium Polystyrene Sulfonate | Sodium Cellulose Sulfate | Sodium Cellulose Sulfate |
| Preservative | Phenol | Compound (1) | Phenol | Compound (1) |
| Viscosity | | | | |
| Fresh | 110 | 115 | 178 | 180 |
| 3 Days after | 60 | 110 | 70 | 180 |

As can be seen from he results in Table 1 above, when Compound (1) was used as in the present invention, as a preservative, the viscosity was reduced less and the preservation effects were excellent, while the amount was about 1/12 times that of phenol.

EXAMPLE 2

The preservatives as used in the present invention and phenol were added to an aqueous gelatin solution, containing 1.5 wt% of sodium polystyrene sulfonate or sodium cellulose sulfate as viscosity-increasing agents based on the dry gelatin, in amounts of 1 wt% and 5 wt%, respectively, based on the dry gelatin. Thus, the final gelatin concentration was 7.5%. The viscosities of these solutions were measured using the same method as in Example 1 and the results obtained are shown in Table 2 below.

TABLE 2

| | Sample No. | | | | | | | | | | | | | | |
|---|---|---|---|---|---|---|---|---|---|---|---|---|---|---|---|
| Viscosity-Increasing Agent | None | | | | | Sodium Polystyrene Sulfate (1.5 wt %/gelatin) | | | | | Sodium Cellulose Sulfate (1.5 wt %/gelatin) | | | | |
| | V | VI | VII | VIII | IX | X | XI | XII | XIII | XIV | XV | XVI | XVII | XVIII | XIX |
| Preservative | None | Phenol | Phenol | Compound (1) | Compound (1) | None | Phenol | Phenol | Compound (1) | Compound (1) | None | Phenol | Phenol | Compound (1) | Compound (1) |

TABLE 2-continued

| Viscosity-Increasing Agent | Sample No. | | | | | | | | | | | | | | |
|---|---|---|---|---|---|---|---|---|---|---|---|---|---|---|---|
| | None | | | | | Sodium Polystyrene Sulfate (1.5 wt %/gelatin) | | | | | Sodium Cellulose Sulfate (1.5 wt %/gelatin) | | | | |
| | V | VI | VII | VIII | IX | X | XI | XII | XIII | XIV | XV | XVI | XVII | XVIII | XIX |
| Preservative Amount Added (wt %/gelatin) | — | 1 | 5 | 1 | 5 | — | 1 | 5 | 1 | 5 | — | 1 | 5 | 1 | 5 |
| Viscosity | 16 | 16 | 15 | 16 | 16 | 150 | 115 | 50 | 150 | 150 | 230 | 170 | 40 | 230 | 150 |

From the results shown in Table 2, the following conclusions can be drawn. Where phenol is added to the gelatin solution (Sample XII and Sample XVII) in an amount sufficient to achieve sufficient preservation effects, the viscosity becomes extremely low as a result of the inhibition of the viscosity-increasing effect by phenol. On the other hand, Compound (1) of the present invention causes an extremely small reduction in viscosity to occur even when a large amount thereof is used based on the dry gelatin. Thus, the viscosity-increasing effect of the viscosity-increasing agent is not inhibited by the preservative.

COMPARISON EXAMPLE

In order to examine the preservation effects, a sample was prepared by adding 0.1 wt% of Compound (1) as used in the present invention based on the dry gelatin (Sample (XX)), samples obtained by adding 0.1, 1.25 and 2.5 wt% of phenol respectively, based on the dry gelatin (Sample (XXII), Sample (XXIII), and Sample (XXIV)) and a sample obtained by adding 0.1 wt% of neomycin (as described in Japanese Pat. No. 14081/1967) based on the dry gelatin (Sample (XXI)) to a 10 wt% aqueous gelatin solution. The viscosity and turbidity were measured immediately after preparation of these solutions, after storage for 3 days at 40° C., and after storage for 6 days at 40° C. The results obtained are shown in Table 3 below. Turbidity was determined by measuring the absorbance at 550 nm.

TABLE 3

| | Sample | | | | |
|---|---|---|---|---|---|
| | XX | XXI | XXII | XXIII | XXIV |
| Preservative Amount Added (%/dry gelatin | Compound (1) 0.1 | Neomycin 0.1 | Phenol 0.1 | Phenol 1.25 | Phenol 2.5 |
| Fresh Viscosity (cps) | 22 | 21 | 21 | 22 | 22 |
| Turbidity | 21 | 21 | 21 | 22 | 21 |
| 3 Days Storage Viscosity (cps) | 19 | 19 | 6 | 18 | 19 |
| Turbidity | 23 | 25 | 52 | 35 | 23 |
| 6 Days Storage Viscosity (cps) | 17 | 15 | 3.5 | 5.6 | 15 |
| Turbidity | 23 | 26 | 73 | 55 | 23 |

As is clear from the results in Table 3, Compound (1) of the present invention exhibits excellent preservation effect.

While the invention has been described in detail and with reference to specific embodiments thereof, it will be apparent to one skilled in the art that various changes and modifications can be made therein without departing from the spirit and scope thereof.

What is claimed is:

1. A method for preventing the degradation of a hydrophilic colloid solution by the action of bacteria, mold or yeast for a silver halide photographic light-sensitive material, in which the viscosity of the solution thereof has been or is to be increased using an anionic polymer containing an acid group, whereafter said hydrophilic colloid solution is used in a multi-coating process at a speed of about 20 m/min or more, which comprises incorporating into said hydrophilic colloid solution at least one compound represented by the formula (I):

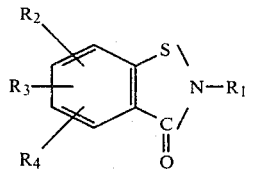

(I)

wherein $R_1$ represents a hydrogen atom or an alkyl group; and $R_2$, $R_3$ and $R_4$, which may be the same or different, each represents a hydrogen atom, a halogen atom, an alkyl group or an alkoxy group and, increasing said viscosity if said viscosity has not already been increased by the addition of said anionic polymer by adding said anionic polymer containing an acid group to said hydrophilic colloid soluton, whereby said degradation is prevented without any adverse effect on viscosity increase.

2. The method of claim 1, wherein said hydrophilic colloid is gelatin or a gelatin derivative.

3. The method of claim 1, wherein $R_1$ through $R_4$ are all hydrogen atoms.

4. The method of claim 1, wherein said anionic polymer is a polymer having a sulfonyl group, a carboxyl group or a sulfato group.

5. The method of claim 1, wherein said compound is incorporated in an amount of about $1\times10^{-2}$ to about $2.5\times10^{-1}$ wt% based on the dry weight of the hydrophilic colloid.

6. The method of claim 4, wherein said anionic polymer is at least one polymer selected from a polystyrene sulfonic acid salt and a cellulose sulfuric acid salt.

7. The method of claim 1, wherein the viscosity has already been increased.

8. The method of claim 1, wherein the viscosity has not been increased and is increased by adding said anionic polymer.

9. The method of claim 1, wherein the acid group is at least one sulfonic acid group, carboxylic acid group or sulfonic acid group, and the acid group is present in a side chain of the anionic polymer.

10. The method of claim 9, wherein the anionic polymer containing an acid group is selected from polymers or copolymers of monomers from the class consisting of styrene sulfonic acid, 2-acrylamido-2-methylpropane sulfonic acid, acrylic acid, methacrylic acid, maleic acid, half esters of maleic acid, phosphoric acid mono esters of hydroxyethyl acrylate and a cellulose sulfuric acid salt.

11. The method of claim 9, wherein the anionic polymer containing an acid group is selected from the class consisting of polystyrene sodium sulfonate, sodium polyacrylate and sodium cellulose sulfate.

12. The method of claim 10, wherein the anionic polymer having an acid group is present in an amount of 1 to 100 wt % based on the dry weight of the hydrophilic colloid.

13. The method of claim 11, wherein the anionic polymer having an acid group is present in an amount of 1 to 100 wt % based on the dry weight of the hydrophilic colloid.

14. The method of claim 1, wherein the compound of general formula (I) and the anionic polymer having an acid group are present in a non-light sensitive hydrophilic colloid solution.

* * * * *